US006000840A

United States Patent [19]

Paterson

[11] Patent Number: 6,000,840

[45] Date of Patent: Dec. 14, 1999

[54] ROTORS AND STATORS FOR MIXERS AND EMULSIFIERS

[75] Inventor: John A. Paterson, Stuart, Fla.

[73] Assignee: Charles Ross & Son Company, Hauppauge, N.Y.

[21] Appl. No.: 08/991,977

[22] Filed: Dec. 17, 1997

[51] Int. Cl.[6] ..... B01F 5/12

[52] U.S. Cl. ..... 366/264; 366/270; 366/305; 366/330.3; 241/46.11; 241/89.3; 416/237

[58] Field of Search ..... 366/64–66, 96–98, 366/102–104, 262–265, 270, 305, 330.1–330.7, 342, 343; 416/183, 231 A, 235, 237, 243; 415/173.1, 173.5, 208.3, 211.1; 241/46.11, 46.17, 89.3

[56] References Cited

U.S. PATENT DOCUMENTS

| | | | |
|---|---|---|---|
| 481,668 | 8/1892 | Howard . | |
| 2,875,897 | 3/1959 | Booth | 366/270 |
| 3,194,540 | 7/1965 | Hager | 366/305 |
| 3,195,867 | 7/1965 | Mould, Jr. | 366/305 |
| 3,229,965 | 1/1966 | Hill | 366/270 |
| 3,894,694 | 7/1975 | Rothman | 241/46.11 |
| 4,779,990 | 10/1988 | Hjort et al. | 366/343 |
| 5,198,156 | 3/1993 | Middleton et al. | 366/263 |
| 5,246,289 | 9/1993 | Middleton et al. | 366/270 |
| 5,632,596 | 5/1997 | Ross . | |

OTHER PUBLICATIONS

Ross Mixer Emulsifier Evolutionary Engineering Pamplet, Nov. 1993.
Ross Versamix Evolutionary Engineering Pamplet, Feb. 1992.
Rotostat High–Shear Mixer Pamplet, Feb. 1994.
Kady International Pamplet, date unknown.
Chemical Processing Pamplet (Jul. 1987).
Special Advertising Section RE: High Shear Mixing, Jun. 1986.
The Silverson Principle Pamplet, date unknown.

*Primary Examiner*—Charles E. Cooley
*Attorney, Agent, or Firm*—Galgano & Burke

[57] ABSTRACT

A rotor-stator assembly having a stator and a rotor for mixing and emulsifying materials in which the rotor includes wedge-shaped rotor blades and the stator includes generally V-shaped openings which together impart additional and increased high speed shearing forces and/or pressures on the mixture thereby resulting in a finer reduction of agglomerates and mixture uniformity. The rotor blades preferably comprise a wedge-shaped leading edge and desirably the blades have a V-shaped cross-section. The stator preferably includes a first plurality of elongated, spaced-apart slots, and a second plurality of spaced-apart slots. The slots are disposed so as to define a generally V-shaped configuration around the circumference of the stator.

24 Claims, 8 Drawing Sheets

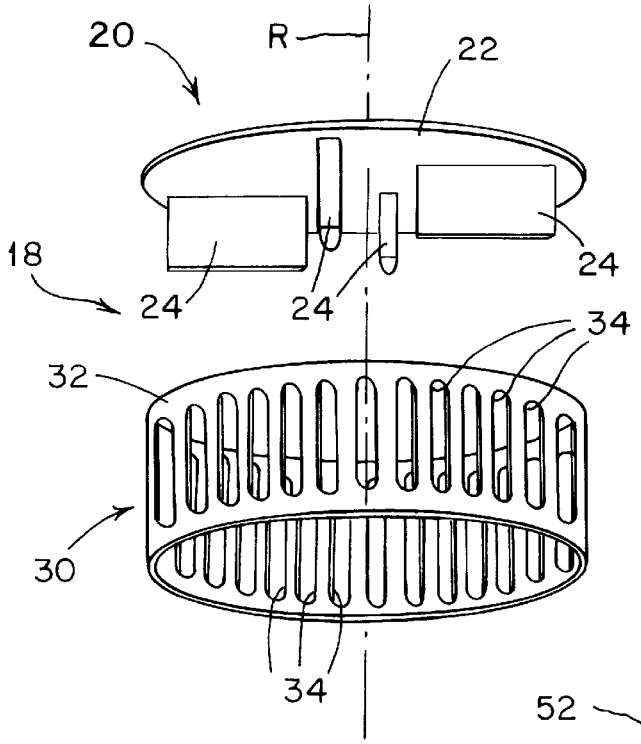
FIG. 2
(PRIOR ART)
FIG. 4
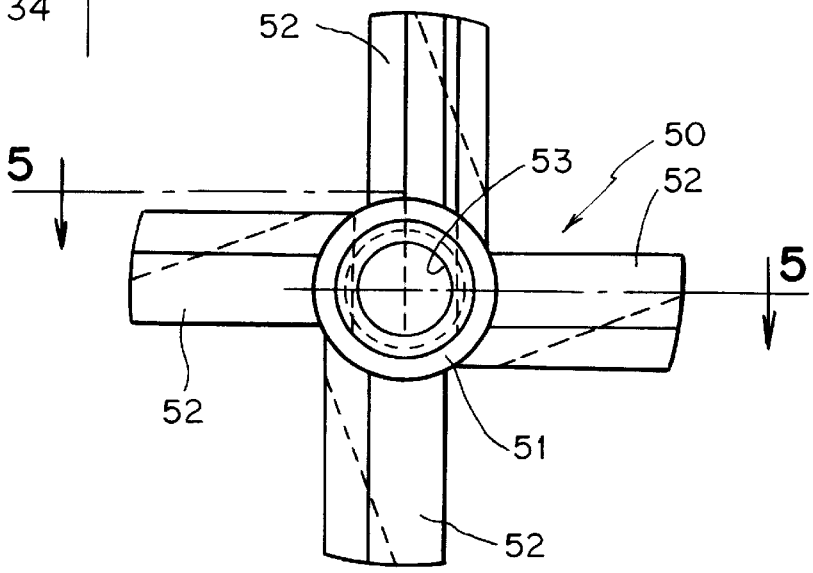
FIG. 5
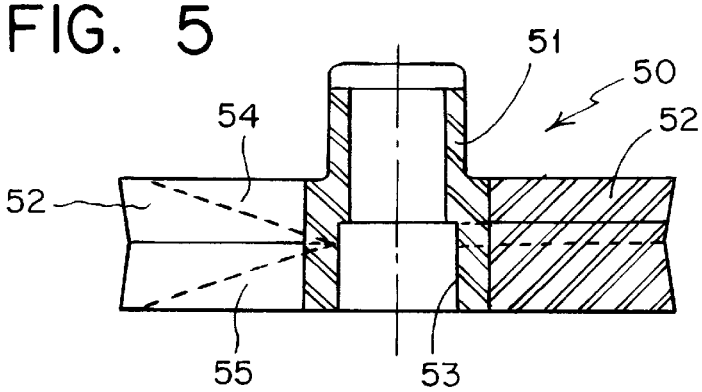

ROTORS AND STATORS FOR MIXERS AND EMULSIFIERS

BACKGROUND OF THE INVENTION

The present invention relates generally to mixers and emulsifiers used in industrial applications. More particularly, the present invention relates to rotors and stators which are used in industrial mixers and emulsifiers.

SUMMARY OF THE INVENTION

Industrial mixers and emulsifiers are used to blend various materials such as adhesives, coatings, cosmetics, foods, pharmaceuticals, plastics, paints, etc. Depending on the processing requirements, mixers/emulsifiers may be arranged as a "batch" mixer or an "in-line" mixer. In either case, high speed mechanical and hydraulic shearing forces are created by rotating a rotor relative to a stator such that material is drawn into the rotor-stator assembly and dispersed radially outward from the rotor-stator assembly.

FIG. 1 illustrates a typical prior art high sheer mixer 10 disposed in a tank 11 for batch mixing. Mixer 10 comprises a motor 12 attached to a rotor shaft 14, two stationary supports 16, and a rotor-stator assembly 18.

As best seen in FIG. 2, rotor-stator assembly 18 comprises a rotor 20 and a stator 30. Rotor 20 comprises a stainless steel disk 22 with four vanes or blades 24 rotatable about an axis of rotation R. Blades 24 have a rectangular-shaped cross-section when viewed from the side. In addition, the front or leading surface and the rear or trailing surface of each blade 24 are disposed parallel to axis R. Stator 30 comprises a stainless steel, hollow cylinder 32 having a plurality of elongated, vertically extending, slots 34. Rotor 20 is mounted coaxially at close tolerances within the stator 30 and is rotated at a typical speed of 3600 rpm.

The mixing process of the prior art rotor-stator assembly shown in FIGS. 1 and 2 can be broken down into four stages. In stage 1, the high speed rotation of the rotor blades 24 within stator 30 draws material upwardly from the bottom of the tank and into the center of rotor 20. In stage 2, centrifugal forces then drive material toward the outer periphery of blades 24 where the material undergoes mechanical shearing between the ends of blades 24 and the inner wall of stator 30.

In stage 3, the material undergoes hydraulic shear as it is forced out through openings 34 of stator 30. In stage 4, the radially expelled mixture is projected toward the sides of tank 11 upon which it is deflected, and at the same time fresh material is continually drawn into the center of rotor 20 maintaining the mixing process. To increase circulation or to create a vortex for the incorporation of light solids, down thrust and circulation propellers may be mounted on the rotor shaft.

Other prior art rotor-stator assemblies have included stators having circular-shaped holes, square-shaped apertures, and diagonally disposed slots. While the prior art rotor-stator assemblies are generally suitable for their intended purpose of mixing materials, there is a need for rotor-stator assemblies which impart increased and/or additional shearing forces on the materials to mix and/or emulsify the materials more quickly and completely.

SUMMARY OF THE INVENTION

It is therefore an object of the present invention to provide novel rotor-stator assemblies which produce improved quality mixtures as represented by finer reduction of agglomerates and uniformity of the resulting mixture.

It is another object of the present invention to provide rotor-stator assemblies which are comparable to commercial dispersers in mixing and emulsifying.

It is another object of the present invention to provide rotor-stator assemblies which impart increased and/or additional high speed shearing forces and/or increased pressures on the mixture.

It is another object of the present invention to provide rotor-stator assemblies which produce improved movement, flow, pumping action, and heat exchange.

It is still another object of the present invention to provide rotor-stator assemblies which reduce production time and are energy efficient.

It is yet another object of the present invention to provide rotor-stator assemblies which are suitable for a variety of mixing operations, e.g., mixing, emulsifying, homogenizing, disintegration, dissolving, dispensing, blending, particle size reduction, and de-agglomerating, and for a variety of applications, e.g., foods, plastics, adhesives, pharmaceuticals, cosmetics, and coatings.

Certain of the foregoing and related objects are readily obtained in a rotor-stator assembly for mixers and emulsifiers comprising a stator comprising a plurality of openings and a rotor rotatable relative to the stator. The rotor comprises a plurality of blades and means for supporting the blades for rotation about an axis of rotation, wherein at least one of the blades comprises a surface disposed at an oblique angle relative to the axis of rotation.

Preferably, the rotor comprises at least one blade comprising a pair of surfaces so as to define a wedge-shaped blade. Desirably, the surfaces are disposed at an angle between about 45 degrees and about 135 degrees, and preferably about 90 degrees, relative to each other. Advantageously, the rotor comprises a plurality of wedge-shaped blades, and preferably a plurality of blades comprising a V-shaped cross-section.

Also preferably, the plurality of openings extend through the stator and are arranged generally in pairs to define a generally V-shaped pattern. Desirably, the plurality of generally V-shaped openings comprise a plurality of elongated slots disposed at an oblique angle relative to the axis of rotation. Preferably, the plurality of generally V-shaped openings comprise a first plurality of elongated slots and a second plurality of elongated slots wherein the elongated slots are disposed at an angle between about 45 degrees and about 135 degrees, and preferably about 90 degrees, relative to each other. The openings in the stator extend around a portion of the stator, and desirably, completely around the stator.

Advantageously, the stator comprises a plurality of V-shaped openings and the rotor comprises a plurality of wedge-shaped blades. Preferably, the V-shaped openings and the wedge-shaped blades are disposed in opposite directions relative to each other.

BRIEF DESCRIPTION OF THE DRAWINGS

These and other objects and advantages of the present invention will become apparent from the following description of the accompanying drawings, which disclose one embodiment of the present invention. It is to be understood that the drawings are to be used for purposes of illustrations only, and not as a definition of the invention.

In the drawings, wherein similar reference numerals denote similar elements throughout the several views:

FIG. 2 is an enlarged, exploded, perspective view of the prior art rotor-stator assembly shown in FIG. 1;

FIG. 4 is a top view of the rotor shown in FIG. 3;

FIG. 5 is a cross-sectional view of the rotor taken along line 5—5 of FIG. 4;

DETAILED DESCRIPTION OF THE PREFERRED EMBODIMENTS

Figure 3:
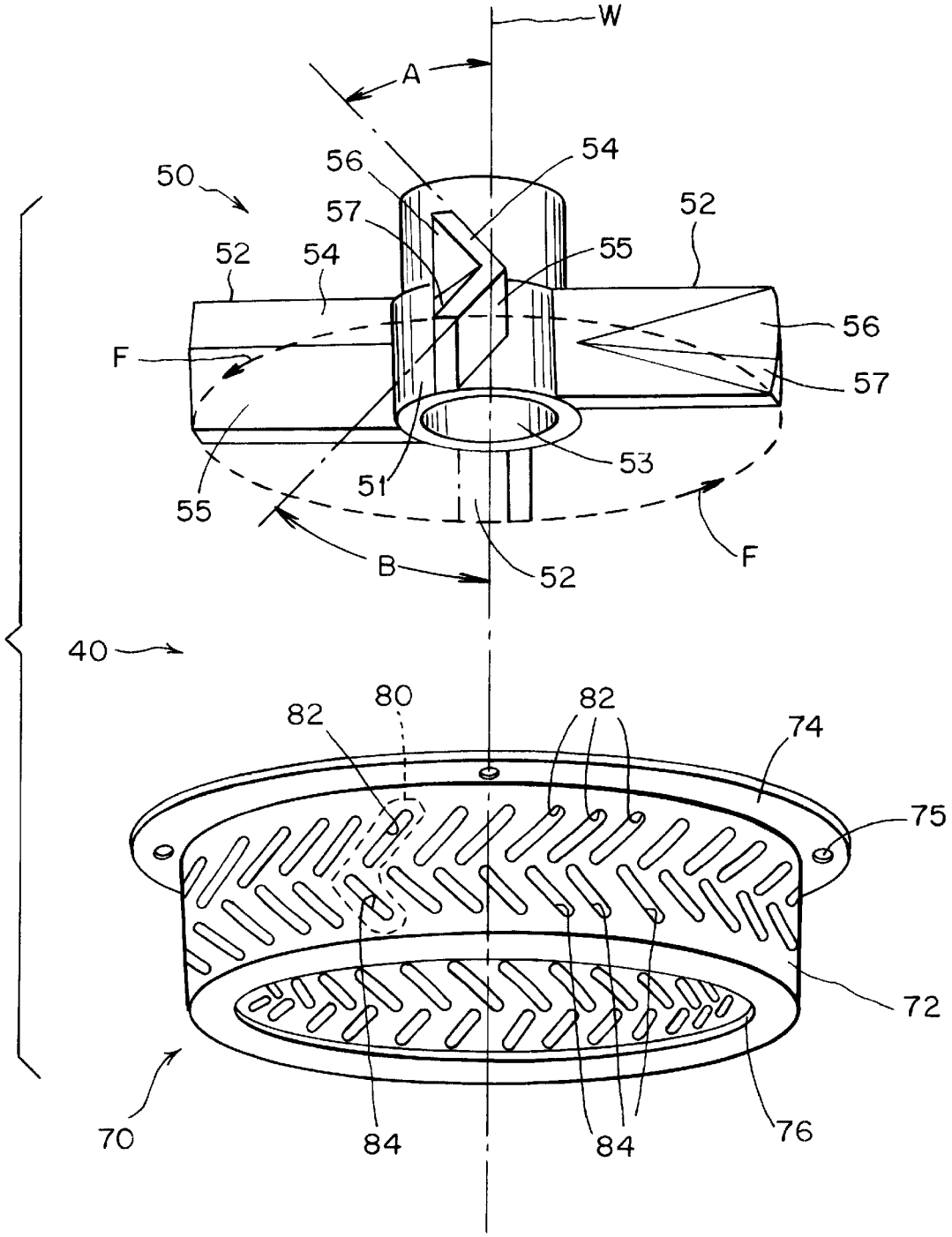
FIG. 3 is an exploded perspective view of one embodiment of the rotor-stator assembly according to present invention.

Turning now to the drawings, therein illustrated in FIG. 3 is one embodiment of a novel rotor-stator assembly 40 according to the present invention which includes a rotor 50 and a stator 70. As will be described in greater detail below, the design and configuration of rotor 50 having wedge-shaped blades and stator 70 having V-shaped openings impart increased and/or additional shearing forces and/or pressures on the mixture resulting in a finer reduction of agglomerates and mixture uniformity.

With reference to FIGS. 3, 4, and 5, rotor 50 includes a collar or ring 51 having a centrally disposed bore 53 which is conventionally attachable to a motor via a shaft (not shown), and four laterally-extending, angularly and/or radially spaced-apart, wedge-shaped blades 52. Rotor 50 is rotatable in a clockwise direction (when viewed looking down) about an axis of rotation W (FIG. 3) which also corresponds to the longitudinal axis of stator 70.

As best seen in FIG. 3, the surfaces of the blades of the rotor are sloped or inclined similar to the surfaces on a fan or propeller. In this illustrated embodiment, blades 52 include a V-shaped rearward portion or trailing edge having surfaces 54 and 55 disposed at oblique angles A and B, respectively, relative to axis W, i.e., surfaces 54 and 55 are neither parallel nor perpendicular to axis W. Desirably, surfaces 54 and 55 are disposed at an angle between about 45 degrees and about 135 degrees, and preferably about 60 degrees and about 120 degrees, relative to each other. Advantageously, surfaces 54 and 55 are disposed at about equal angles from a centerline, e.g., a line dividing the width of the blade into a top half and bottom half. Most preferably, surfaces 54 and 55 are disposed at an angle of about 90 degrees relative to each other and about 45 degrees from axis W.

Preferably, blades 52 include a V-shaped forward portion or leading edge having surfaces 56 and 57 also disposed at oblique angles relative to axis W. In this illustrated embodiment, surfaces 56 and 57 are spaced-apart from the trailing edge and are not parallel to surfaces 54 and 55, respectively, but are disposed on an angle relative thereto so that the leading edge defines a triangular or delta-shaped cutout in blade 52. Desirably, surfaces 56 and 57 are disposed at an angle between about 45 degrees to about 135 degrees, and preferably between about 60 degrees and about 120 degrees, relative to each other. Advantageously, surfaces 56 and 57 are disposed at equal angles from a centerline. Most preferably, surfaces 56 and 57 are disposed at an angle of about 90 degrees relative to each other and about 45 degrees from axis W. From the present description, it will be appreciated to those skilled in the art that trailing edge surfaces can be parallel to the leading edge surfaces so that the rotor blades have a constant V-shaped cross-section. In addition, while the illustrated rotor has a constant angle of pitch it will be appreciated that the surfaces of the blades can vary along their length, e.g., the blades can be provided with a twist similar to the blades of a propeller. Furthermore, it will be appreciated that the leading edge surfaces and trailing edge surfaces can be disposed at different angles with respect to each other and axis W.

Figure 6:
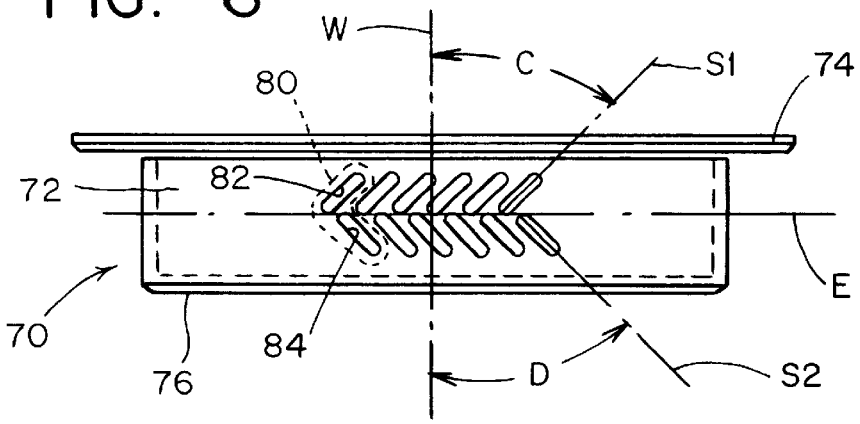
FIG. 6 is a side elevational view of the stator shown in FIG. 3.

With reference to FIGS. 3 and 6, stator 70 includes a generally vertically extending cylindrical sidewall 72, an upper peripheral, outwardly-extending flange 74, and a lower peripheral, inwardly-extending flange 76. Upper flange 74 is provided with a plurality of holes 75 (FIG. 3) for suitably attaching stator 70 to a stationary support of a batch-type mixing system, e.g., a stationary lower frame flange 100 shown in FIG. 7.

Stator 70 includes two rows of generally paired spaced-apart openings extending through sidewall 72 arranged in a chevron-like or V-shaped pattern. In this illustrated embodiment, each generally V-shaped paired openings 80 includes elongated slots 82 and 84. In particular, generally V-shaped openings 80 comprises a first row of elongated, radially spaced-apart slots 82, and a second row of elongated, radially spaced-apart slots 84.

As best seen in FIG. 6, slots 82 are horizontally spaced-apart from each other in a row around the circumference of sidewall 72, and slots 84 are horizontally spaced-apart from each other in a row around the circumference of sidewall 72. In addition, slots 82 are vertically disposed above slots 84, and slots 82 and 84 are offset relative to each other.

In this illustrated embodiment of stator 70, slots 82 and 84 have longitudinally extending axes S1 and S2 which are disposed at oblique angles C and D, respectively, relative to axis W. In addition, slots 82 and 84 are disposed around stator 70 along a circumference so as to define a centerline E. When viewed from the side, centerline E which is disposed desirably perpendicular to the axis W about which rotor 50 is rotatable and which corresponds to the longitudinal axis of stator 70. Desirably, slots 82 and 84 are disposed at an angle between about 45 degrees and about 135 degrees, and preferably, about 60 degrees and about 120 degrees from each other. Most preferably, slots 82 and 84 are disposed at an angle of about 90 degrees relative to each other and about 45 degrees from centerline E.

Referring again to FIG. 3, the diameter of rotor 50, i.e., as measured between the outer radial edges of blades 52, is dimensioned to fit within the inner surface of cylindrical sidewall 72 of stator 70. Preferably, a gap or clearance of about 0.005 inch to about 0.020 inch is provided between the outer radial ends or tips of blades 52 of rotor 50 and the inner surface of cylindrical sidewall 72 of stator 70. Desirably, rotor 50 rotates within stator 70 in the clockwise direction of arrows F.

Figure 7:
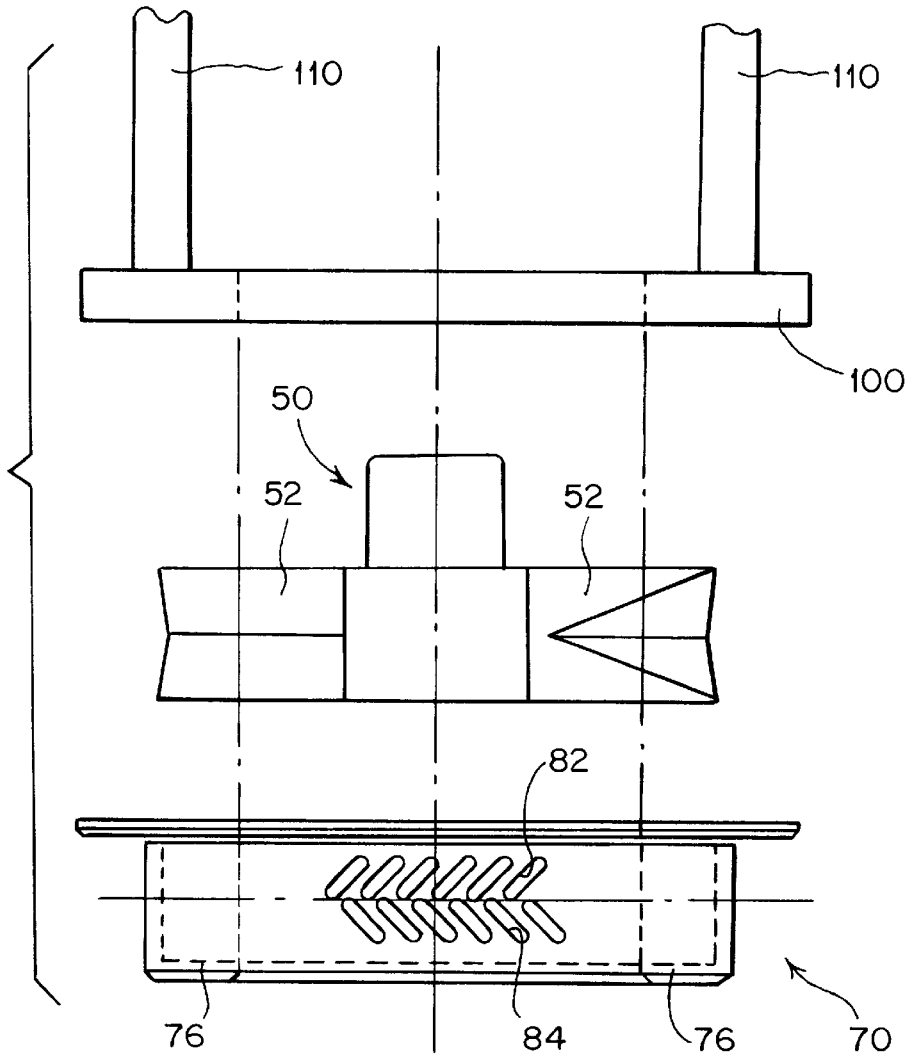
FIG. 7 is an exploded side elevational view of the rotor-stator assembly shown in FIG. 3 and a lower frame flange of a stationary support.

FIG. 7 illustrates the attachment of rotor-stator assembly 40, and in particular, stator 70 to lower frame flange 100.

Lower frame flange 100 is welded to two support rods which are welded to a stationary upper frame flange (not shown) which is bolted to the main drive support structure. It will be appreciated that three or more support rods can be used to connect the lower frame flange to the upper frame flange.

Rotor 50 is mounted to the shaft (not shown) that runs in the center of the support rods 110 and lower frame flange 100. Stator 70 is then mounted, e.g., with bolts, to the lower frame flange 100. Preferably, the inside diameter of lower frame flange 76 of stator 70 is equal to the inside diameter of lower frame flange 100 and are sized less than the outside diameter of the blades of rotor 50 so that the end portions of blades 52 of rotor 50 are enclosed. During a mixing operation, fluid is forced toward the ends of blades 52 of rotor 50 and restrained between lower flange 76 of stator 70 and lower frame flange 100. Desirably, lower frame flange 100 and lower flange 76 of stator 70 prevent fluid from escaping either up or down and the centrifugal force of the fluid reduces the chance of the fluid backing up into the center of rotor 50. This captive area traps the fluid and forces it to escape through the slots 82 and 84 in stator 70 as opposed to allowing material to escape the shear zone (slip reduction).

Figure 1:
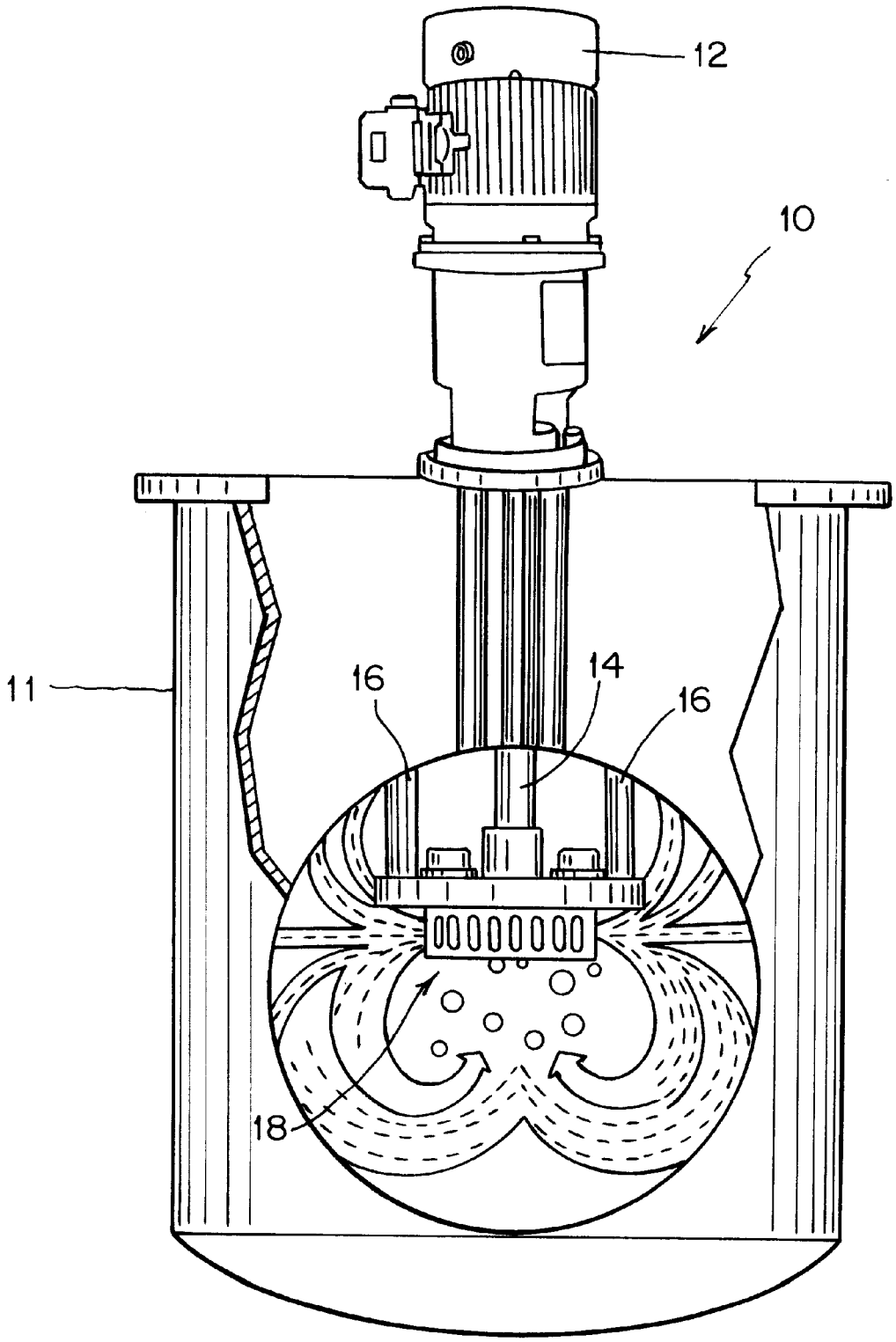
FIG. 1 (PRIOR ART)
FIG. 1 is a side elevational view, partially broken away and enlarged, of a prior art high shear mixer and mixing tank.

The illustrated rotor-stator assembly 40 of the present invention is suitable for "mixing" and "premixing" materials and can be used in the same manner as a high speed disperser (e.g., open-disk impeller type) or a conventional rotor/stator (e.g., FIGS. 1 and 2). For example, rotor-stator assembly 40 may be a hoist mounted device that is raised and lowered into and out of a mixing vessel or it may be directly attached to the top of the vessel without a lift. Rotor-stator assembly 40 may also be incorporated into a multi-shaft mixer that can include a sweep or anchor type blade that scrapes the side walls of the vessel and pumps material back into the center of the vessel and mixing head.

In operation, the rotor is rotated at about 0–12,000 rpms (rotations per minute) resulting in a tip speed of the blades for approximately a 3-inch diameter rotor, of 0–10,000 fpm (feet per minute). Depending on the application, it will be appreciated that the diameter of the rotor can range between about 1½ inches and about 20 inches.

As will be appreciated from the present description, the design of the rotor-stator assembly of the present invention creates a plurality of conventional high speed shearing forces on the mixture which includes:

1) Mechanical shear created by the close clearance between the outer tip of rotor blades and the inside surface of the stator; and
2) Hydraulic shear as the mixture is forced out through the slots in the stator.

In addition, the design of the present invention produces additional and/or increased high speed shearing forces and/or pressures on the mixture which include:

3) Laminar shear—opposing and/or differing velocities of layers of the mixture due to, e.g., velocity changes of the mixture off the angled surfaces of the rotor blades, and off the angled sides of the slots in the stator;
4) Turbulent shear—opposing and/or differing directions and rapid directional changes of the mixture due to, e.g., changes in the direction of the mixture as it transitions off the angled surfaces of the rotor blades and off the angled sides of the slots in the stator;
5) Cavitational shear cavities and/or vortices in the mixture due to the mixture exiting the angled slots in the stator and/or off the trailing edge of rotor blades; and
6) Increased pressure of the fluid mixture caused by the wedge-shaped leading edge of the rotor blades.

Test Results

The rotor-stator assembly of the present invention (hereinafter "Delta System") was evaluated as a pigment incorporator and a batch premix device to determine the effectiveness of the Delta System in improving premix fineness of grind and subsequent reduction of milling time. Comparison was also made to other prior art mixers and to a commercial disperser sample.

An initial test was conducted with the Delta System with a two-inch choke tube installed. The formulation selected was a steel ball mill formula; 20 percent phthalocyanide blue, 40.6 percent total solids, in a nineteen-gallon batch. All raw materials were loaded into the batch and the Delta System acted on the entire volume. However, pigment inclusion into the batch was slow. The results of the initial test indicated a wide distribution of pigment with a substantial population of large particles. A Hegman test was inconclusive due to a complete field of particles appearing throughout the scale. Removal of the choke tube later in the test series, i.e., test three described below, eliminated this problem and the Delta System showed excellent pigment inclusion capabilities.

Figure 8:
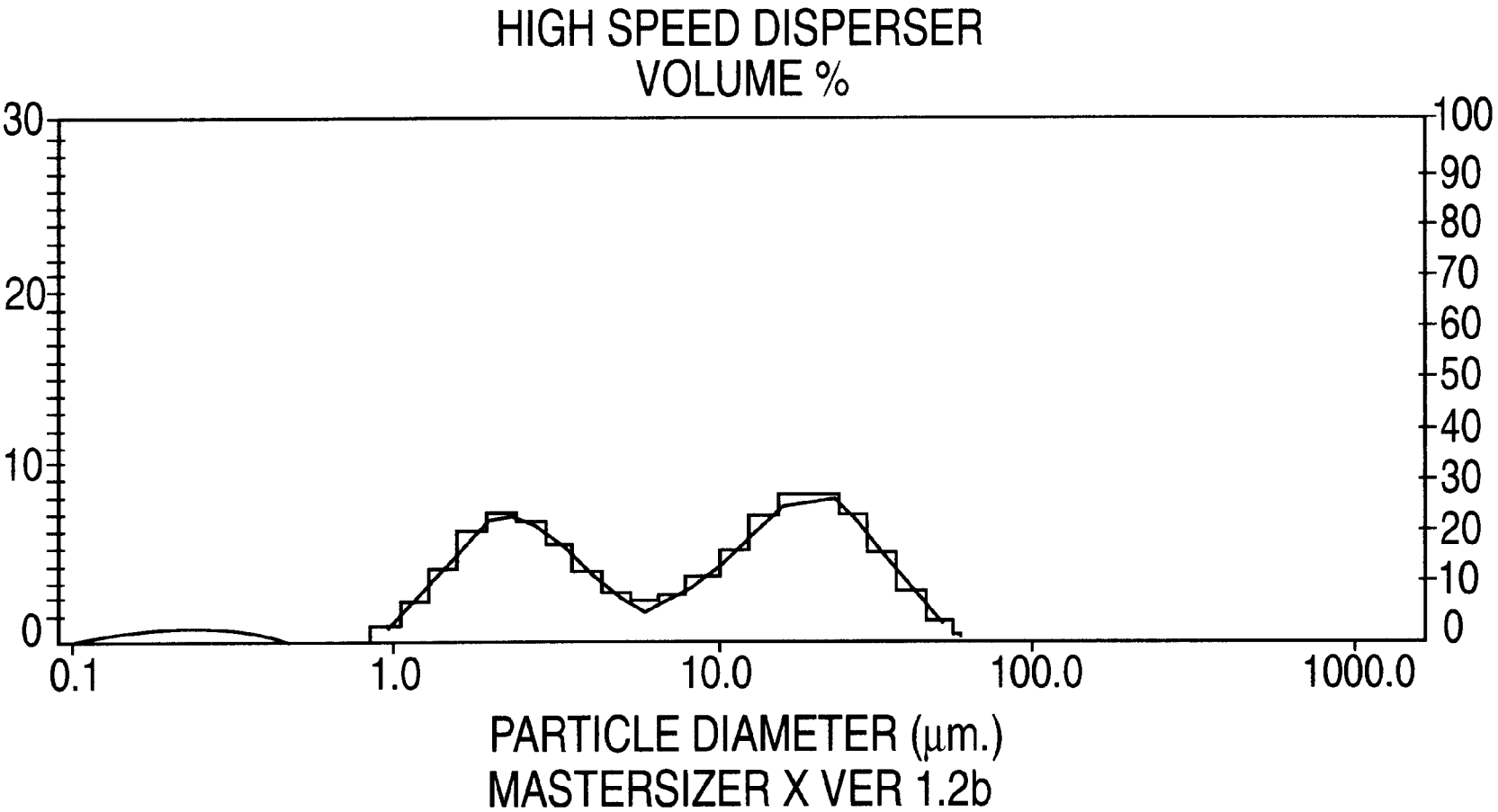
FIG. 8 is a graphical representation (Malvern analysis) of the mixing results of a prior art high speed disperser.

A second test was conducted using a prior art high speed disperser (e.g., an open-disk impeller type) at a standard 5,200 ft/min setting. The high speed disperser operated on the entire batch volume with the same formulation as in the first test. As shown in FIG. 8, the Malvern results of this batch showed an extremely wide particle size distribution with two distinct populations having a median 9.75 micron particle size, and showed very limited de-agglomeration and no dispersion.

Figure 9:
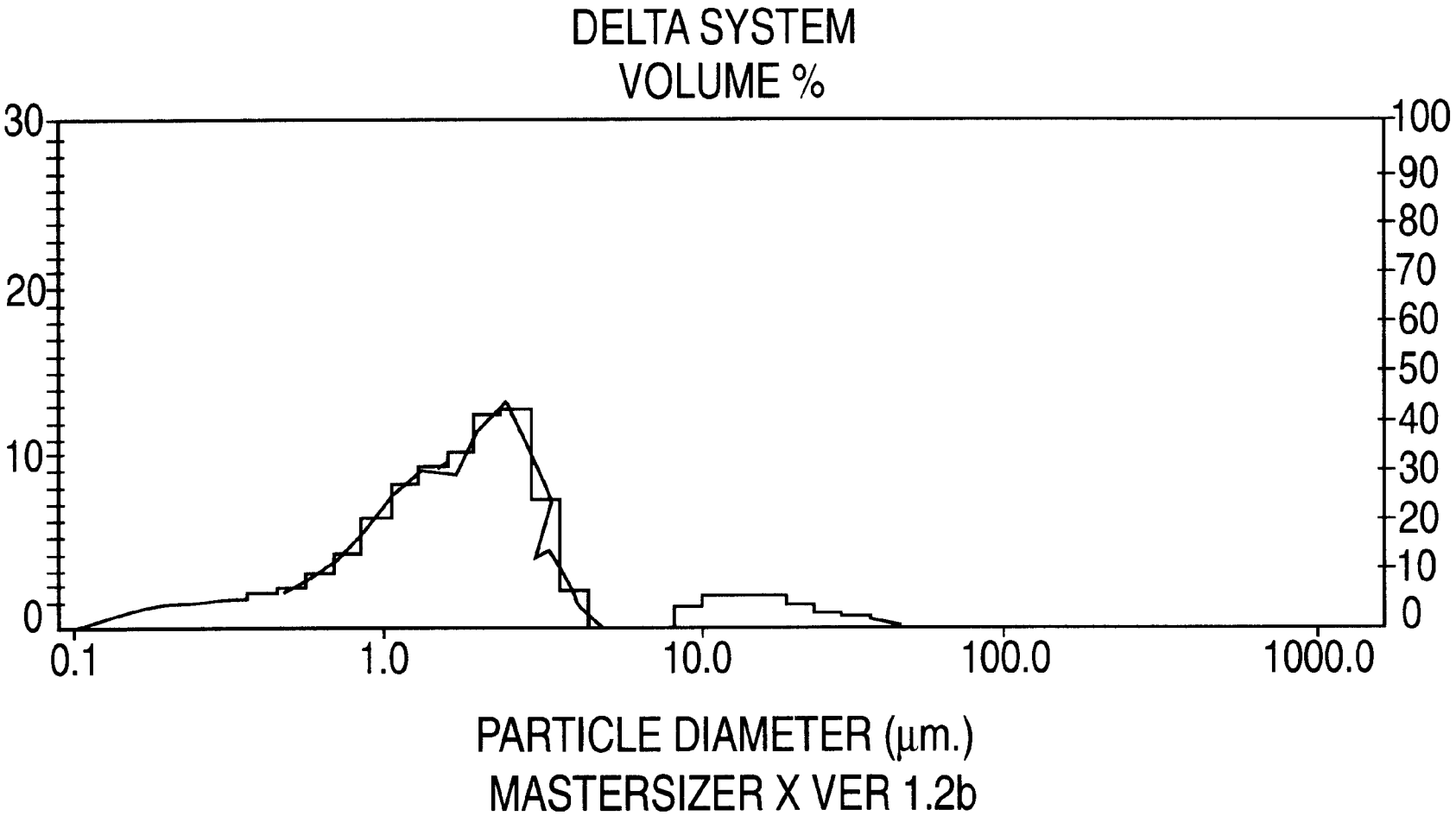
FIG. 9 is a graphical representation (Malvern analysis) of the mixing results of the rotor-stator assembly of the present invention ("Delta System") shown in FIG. 3.

A third test was conducted again using of the Delta System similar to test one, except fifty pounds of mineral spirits was withheld. It was postulated that the higher solids and higher pigment loading due to the withholding of mineral spirits would enhance the effectiveness of the mixing process. Within fifteen minutes, the batch had reached ball mill viscosity and gelled. In an attempt to keep this batch fluid, additions of mineral spirits, wetting resin and/or alkyd resin were made at 15 minutes, 18 minutes, 22 minutes, 28 minutes and 35 minutes. The total solids of the batch increased from 40.6 percent to 52.9 with these additions. The pigment solids remained 20 percent and the vehicle solids increased from 20.6 to 32.9 percent. This fact is of importance since it is indicative of a major increase in surface area during processing. FIG. 9 illustrates the Malvern results of this test.

Figure 10:
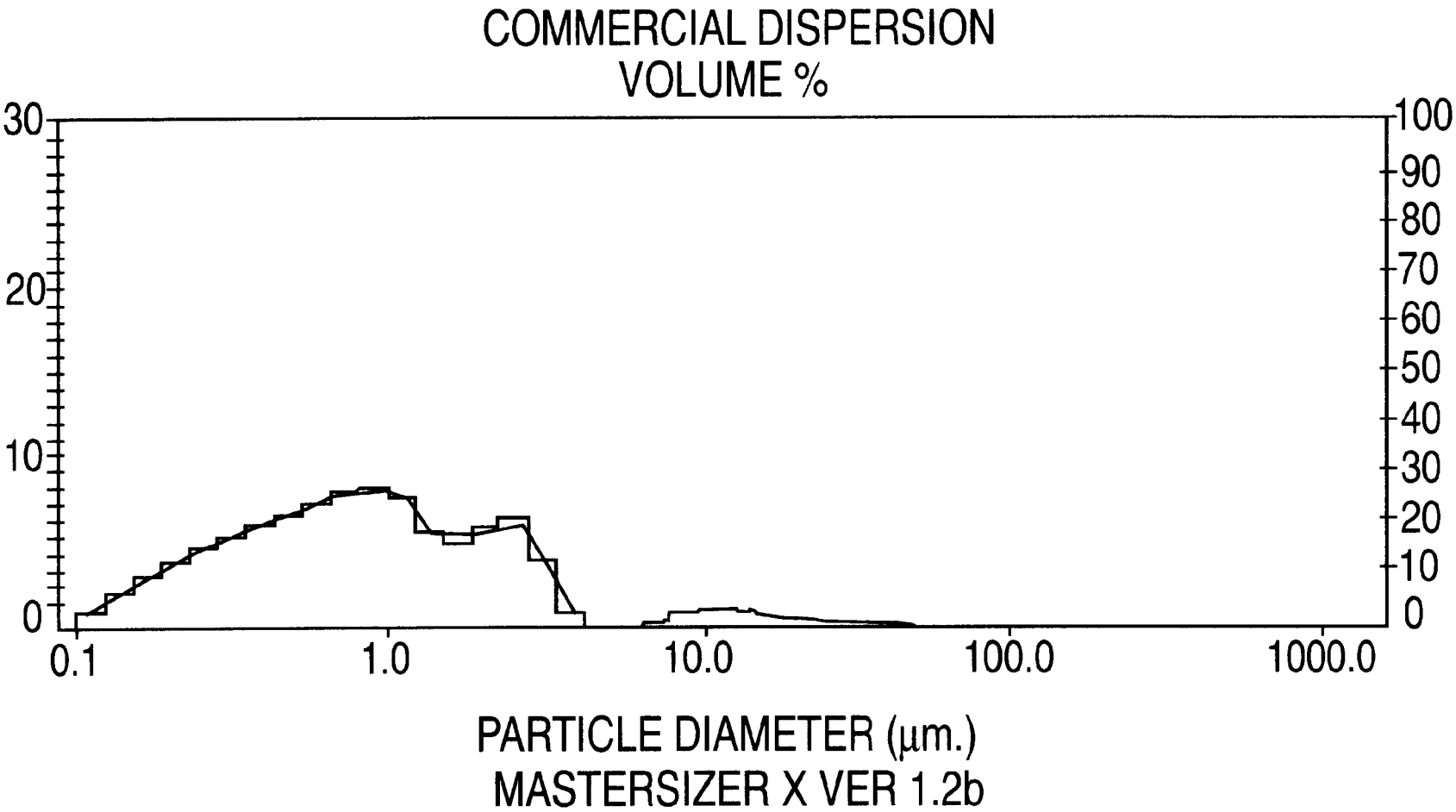
FIG. 10 is a graphical representation (Malvern analysis) of a sample of a commercial dispersion.

A sample of commercial dispersion was obtained and tested. The Malvern analysis results are illustrated in FIG. 10. The dispersion was a 15-2 phthalocyanide blue dispersion in acrylic resin/P.M. acetate, dispersed through a horizontal media mill. A comparison of the Malvern analysis of the Delta System (FIG. 9) and the commercial dispersion (FIG. 10) showed an exact duplication of particle size range in both products. The results of the Delta System show a particle population skewed toward large particles, but all particles were within the confines of the commercial dispersion. Desirably, the Delta System placed all particles of a premix within the parameters of a completed dispersion.

A fourth test was conducted with the objective of determining if the population of large particles appearing on the Malvern was bentonite clay anti-settling additive (the commercial dispersion was obtained at this time). The formula was modified with increased alkyd resin and wetting resin, and forty pounds mineral spirits was withheld. The batch gelled in nineteen minutes. Addition of the forty pounds hold out of mineral spirits, e.g., alkyd resin, wetting resin and mineral spirits, failed to fluidize the batch. One fourth of the batch was removed and the weight replaced with alkyd resin, wetting resin and mineral spirits. The resulting fifteen percent pigment concentration was identical to a typical horizontal mill formulation. The modified batch was further processed on the Delta System achieving results similar to test three.

Figure 11:
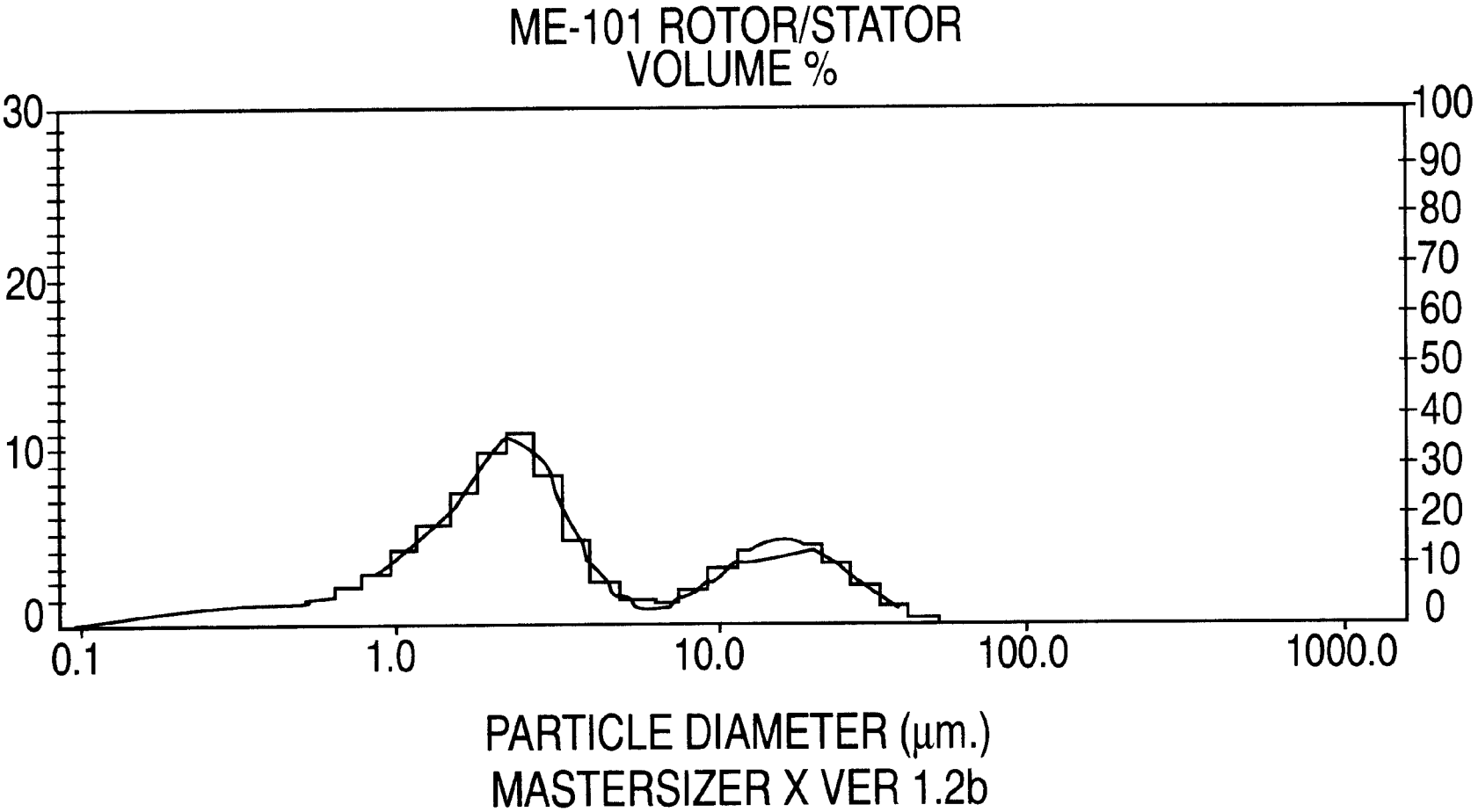
FIG. 11 is a graphical representation (Malvern analysis) of the prior art rotor-stator assembly, e.g., similar to that shown in FIGS. 1 and 2.

A fifth test was conducted with a ME-101 rotor-stator assembly (e.g., similar to the rotor-stator assembly shown in FIGS. 1 and 2) operating on the original formulation. The Malvern results of this batch are illustrated in FIG. 11.

As seen in FIGS. 8–11, the Delta System is an extremely aggressive machine. Inclusion of all pigment particles within the domain of a dispersion is impressive and exactly what a premix system should accomplish. The Delta System is also very fast, achieving its results within one half hour for this formulation. Other organic pigments should show a similar profile. It should be noted that with the proper formulation, $TiO_2$ and synthetic iron oxides may be completed with the Delta System, and not require further milling.

A review of the Malvern results of Delta System (FIG. 9), and the commercial dispersion (FIG. 10), show conclusive evidence that the Delta System can produce a particle size population within the parameters of a dispersion. This achievement is currently unknown to the coatings industry, and importantly, the Delta System achieved these results within a high-speed disperser time frame.

A comparison of the Malvern results of the Delta System, the ME-101 rotor-stator assembly, the high speed disperser show the superior performance of the Delta System. An examination of all particle size parameters, median and surface area, support this conclusion. The median particle size for the Delta System, ME-101 rotor-stator assembly, and high speed disperser are 2.0 microns, 3.2 microns, 9.7 microns, respectively. The corresponding surface areas are $5.2M^2/GM$, $3.3M^2/GM$, and $2.2M^2/GM$, respectively. It should be noted that on the fly adjustments of the formulation and equipment were instrumental in obtaining these results.

While the present invention has been shown and described for use with a batch-type mixing setup, it will be appreciated to those skilled in the art that the novel rotor-stator assembly can be configured for use in an in-line mixing setup. It is also appreciated that the rotor can include any number of blades, e.g., two or three blades, or more than four blades. Also, while the illustrated rotor includes a collar from which the blades extend, the rotor may comprise a cylindrical disk or plate wherein the upper portion of the wedge-shaped blades of the present invention are attached to the cylindrical disk, e.g., an attachment of the rotor blade to the disk similar to that shown in FIG. 2.

Desirably, a plurality of interchangeable rotors and stators of the present invention can be provided for handling a variety of mixing applications. The stator of the present invention can also include openings which are sized differently from that shown in the figures, e.g., a plurality of curved or arcuate-shaped slots, and slots forming a plurality of X-shaped openings, and can include more or less than the number of openings shown in the figures. In addition, the rotor-stator assembly of the present invention can be suitably attached to a motor so that the assembly faces upwards and draws material down from the surface of the mixture. Furthermore, it may be possible to provide a stator according to the present invention which rotates, e.g., a stator that rotates in an opposite direction relative to the rotor or which rotates due to fluid movement and is restrained by friction and drag so that the stator rotates at a slower rate relative to the rotor.

Thus, while several embodiments of the present invention has been illustrated and described, it will be appreciated to those skilled in the art that many changes and modifications may be made thereunto without departing from the spirit and scope of the invention.

What is claimed is:

1. A rotor-stator assembly for mixers and emulsifiers, said rotator-stator assembly comprising:

a stator comprising a plurality of openings, said plurality of openings being generally arranged in pairs in a generally V-shaped pattern; and a rotor rotatable relative to said stator, said rotor comprising a plurality of blades and means for supporting said blades for rotation about an axis of rotation, wherein at least one of said blades comprises a surface disposed at an oblique angle relative to said axis of rotation.

2. The rotor-stator assembly according to claim 1, wherein said at least one blade comprises a pair of surfaces so as to define a wedge-shaped edge.

3. The rotor-stator assembly according to claim 2, wherein said surfaces are disposed at an angle between about 45 degrees and about 135 degrees relative to each other.

4. The rotor-stator assembly according to claim 3, wherein said surfaces are disposed at an angle between about 60 degrees and about 120 degrees relative to each other.

5. The rotor-stator assembly according to claim 4, wherein said surfaces are disposed at an angle of about 90 degrees relative to each other.

6. The rotor-stator assembly according to claim 1, wherein said rotor comprises a plurality of wedge-shaped blades.

7. The rotor-stator assembly according to claim 1, wherein said rotor comprises a plurality of wedge-shaped blades having a V-shaped cross-section.

8. The rotor-stator assembly according to claim 1, wherein said plurality of openings comprise a first plurality of elongated slots and a second plurality of elongated slots.

9. The rotor-stator assembly according to claim 1, wherein said plurality of openings of said stator comprises a plurality of elongated slots.

10. The rotor-stator assembly according to claim 9, wherein said plurality of elongated slots are disposed at an oblique angle relative to said axis.

11. The rotor-stator assembly according to claim 1, wherein said openings in said stator extend around a portion of said stator.

12. The rotor-stator assembly according to claim 1, wherein said openings in said stator extend completely around said stator.

13. The rotor-stator assembly according to claim 1, wherein said rotor comprises a plurality of wedge-shaped blades.

14. The rotor-stator assembly according to claim 13, wherein said openings arranged in pairs and said wedge-shaped blades are disposed in opposite directions relative to each other.

15. A stator for mixers and emulsifiers, said stator comprising:

a generally cylindrical sidewall within which a rotor is rotatable about an axis of rotation, said sidewall comprising a plurality of openings extending therethrough and arranged generally in pairs to define a generally V-shaped pattern.

16. The stator according to claim 15, wherein said plurality of openings comprises a plurality of elongated slots.

17. The stator according to claim 16, wherein said plurality of elongated slots are disposed at an oblique angle relative to said axis.

18. The stator according to claim 15, wherein said plurality of openings comprise a first plurality of elongated slots and a second plurality of elongated slots.

19. The stator according to claim 18, wherein said first plurality of elongated slots is disposed at an angle between about 45 degrees and about 135 degrees from said second plurality of elongated slots.

20. The stator according to claim 19, wherein said first plurality of elongated slots is disposed at an angle between about 60 degrees and about 120 degrees from said second plurality of elongated slots.

21. The stator according to claim 20, wherein said first plurality of elongated slots is disposed at an angle of about 90 degrees from said second plurality of elongated slots.

22. The stator according to claim 15, wherein said openings extend around a portion of said stator.

23. The stator according to claim 15, wherein said openings extend completely around said stator.

24. The stator according to claim 15, wherein said openings are disposed along a row around said cylindrical sidewall.

* * * * *

UNITED STATES PATENT AND TRADEMARK OFFICE

CERTIFICATE OF CORRECTION

PATENT NO. : 6,000,840

DATED : December 14, 1999

INVENTOR(S) : John Paterson

It is certified that error appears in the above-indentified patent and that said Letters Patent is hereby corrected as shown below:

Claim 1, line 2, change "rotator-stator" to

-- rotor-stator --.

Signed and Sealed this

Seventh Day of November, 2000

*Attest:*

Q. TODD DICKINSON

*Attesting Officer*

*Director of Patents and Trademarks*